United States Patent [19]

Bailey

[11] 4,065,395

[45] Dec. 27, 1977

[54] ARYL DIUREA-THICKENED GREASES

[75] Inventor: Wayne W. Bailey, Gibsonia, Pa.

[73] Assignee: Gulf Research & Development Company, Pittsburgh, Pa.

[21] Appl. No.: 747,894

[22] Filed: Dec. 6, 1976

[51] Int. Cl.[2] ..... C10M 1/10; C10M 3/02; C10M 1/32; C10M 3/26

[52] U.S. Cl. ..... 252/25; 252/49.6; 252/51.5 A

[58] Field of Search ..... 252/25, 51.5 A, 49.6

[56] References Cited

U.S. PATENT DOCUMENTS

| | | | |
|---|---|---|---|
| 3,920,571 | 11/1975 | Crocker | 252/25 |
| 3,983,041 | 9/1976 | Abbott | 252/25 |

*Primary Examiner*—Delbert E. Gantz
*Assistant Examiner*—Irving Vaughn

[57] ABSTRACT

A grease composition having improved yield, dropping point, and functional life when used in an antifriction bearing at elevated temperatures comprising a base oil of lubricating viscosity thickened with a specially-defined aryl diurea obtained as the result of reacting critical molar ratios of a mixture of p-toluidine and p-chloroaniline with a toluene diisocyanate. In an especially preferred embodiment the grease composition additionally contains precipitated calcium carbonate in an amount sufficient to obtain a grease having improved e.p. (extreme pressure) properties and an extended functional life.

20 Claims, No Drawings

ARYL DIUREA-THICKENED GREASES

BACKGROUND OF THE INVENTION

1. Field of the Invention

Modern technology is currently supplying the general public and the process industries with machinery which is designed to operate under a wider range of temperatures and under greater loads than previously available. In addition, many of the newer machines are designed to operate at extremely high speeds. Many of these machines require certain specific lubricating properties which are not available in conventional lubricants. Thus, modernization of high-speed and high-temperature equipment has strained the petroleum industry for the development of a generation of lubricants capable of satisfying the requirements of the new machines. For example, there has been an increased demand for lubricants capable of performing well at temperatures above 149° C in high-speed bearings and gears for periods in excess of 500 hours. In addition, with the further development of the high-speed sealed bearings, the lubricant must be able to endure for the life of the bearing.

2. Description of the Prior Art

Arylcarbamyl-thickened greases from ureas and diureas which are prepared from a mixture of two different amines and one diisocyanate or a diamine and two monoiisocyanates are described in U.S. Pat. No. 2,710,840. An especially preferred grease disclosed in U.S. Pat. Nos. 3,102,097; 3,154,491; and 3,563,894 is made from bitoylene diisocyanate, p-chloroaniline, and p-toluidine. U.S. Pat. No. 3,374,170 shows the heat-treated combination of 2,4-toluene diisocyanate with p-toluidine in a molar ratio of 1:2 respectively as a suitable grease thickener. A polyorgano siloxane thickened to a grease consistency with a diazo compound and an arylurea wherein the arylurea may be the combination of 2,4 toluene diisocyanate, p-toluidine, and p-chloroaniline is described in U.S. Pat. No. 3,082,170 in Table II Example 0. As evidenced by these patents, the combination of p-toluidine, p-chloroaniline, and toluene diisocyanate and the molar ratio of p-toluidine to p-chloroaniline of up to approximately 1.46:1 are known. The particular molar ratio employed herein and the surprising extended functional life results obtained thereby have not been heretofore described.

SUMMARY OF THE INVENTION

The present invention provides a grease composition having imposed yield, dropping point, and functional life when used in an antifriction bearing at elevated temperatures which comprises:

1. a base oil of lubricating viscosity; and
2. said base oil being thickened to a grease consistency with an amount sufficient to confer said improvements of a specially-defined aryl diurea consisting of the reaction product obtained from the reaction of critical molar ratios of a mixture of p-toluidine and p-chloroaniline with a toluene diisocyanate. An especially preferred grease composition further includes precipitated calcium carbonate in an amount sufficient to obtain a grease having improved e.p. properties and an extended functional life.

BRIEF DESCRIPTION OF THE INVENTION

Base Oil

Any base oil, natural or synthetic, having a lubricating viscosity is suitable for use in the grease composition of the present invention. For example, the base oil can be selected from at least one of the group consisting of a hydrocarbon mineral oil derived from petroleum, a synthetic hydrocarbon oil, a polysiloxane, and a polyol aliphatic ester. All of these oils are well known to those having ordinary skill in the art. The amount and preferred ranges of the base oils are given in Table 2.

The hydrocarbon mineral oil derived from petroleum employed in the grease composition of the present invention can be any of the hydrocarbon oils of lubricating grade customarily used in compounding greases. Suitable hydrocarbon mineral oils can be obtained from coal, shale, tar sands, and petroleum charge stocks. The hydrocarbon mineral oil may be a refined or semirefined oil having a viscosity of about 100 to 4000 SUS (20.5 to 863.6 centistokes) at 37.8° C; preferably a viscosity of about 300 to 3000 SUS (64.7 to 647.7 centistokes) at 37.8° C; and most preferably a viscosity of about 300 to about 1200 SUS (64.7 to 259.0 centistokes) at 37.8° C. Examples of hydrocarbon mineral oils which are useful in the present invention include 500 Texas Oil, 150 MC Bright Stock, and Hydrofinished Heavy Neutral.

Synthetic hydrocarbon oils which can be used herein include those commonly used for lube oils, gear oils, greases, hydraulic fluids, and other functional fluids. An example of a synthetic hydrocarbon oil is a hydrogenated polyalphaolefin (oligomers of certain 1-olefins) derived from normal alpha-olefins, having from about 5 to about 14 carbon atoms, such as 1-decene. The oligomer product is a mixture of the dimer, trimer, tetramer and pentamer with minute amounts of high oligomers sometimes being present. The dimer which, is generally removed for separate use as a functional fluid, is particularly useful as a transformer fluid, to avoid volatilization loss from functional fluids comprising the higher oligomers. Therefore, the primary oligomer product for general use is a mixture of the trimer, tetramer and pentamer. The method of preparing synthetic hydrocarbon oils is well known in the art; and one such method is described in each of the following: Ser. No. 633,671, filed Nov. 20, 1975, Ser. No. 634,624, filed Nov. 24, 1975 and Ser. No. 633,677, filed Nov. 20, 1975. Examples of olefin oligomers which are useful directly or with additives as functional synthetic oils and have a 98.9° C viscosity within the range of 1 cs (centistoke) to 15 cs. Two synthetic hydrocarbon oils useful in the present invention have a viscosity of 4 cs at 98.9° C or 6 cs at 98.9° C.

Polysiloxanes, nonfluorinated and fluorinated, which can be employed in accordance with the present invention are those falling substantially within the lubricating oil viscosity range. In general, suitable polysiloxanes have the following unit structure:

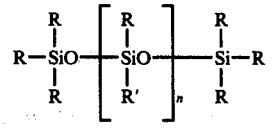

where R and R′ being the same or different, represent substituted or unsubstituted alkyl, aryl, alkylaryl, arylalkyl, or cycloalkyl radicals, wherein R has from 1 to about 10 carbon atoms, and R′ has from 1 to 3 carbon atoms. In the formula, $n$ is an integer ranging from one to about 150, preferably from about 40 to about 150. Such compounds can be produced by well-known methods, e.g., the hydrolysis of dialkyldichlorosilanes or dialkyl diethoxysilanes with a suitable chain stopper, e.g., a trisubstituted monochlorosilane. For purposes of the present invention, those polymers which posses a viscosity of about 25 to 3500 SUS (5.4 to 755.6 centistokes) at 37.8° C; preferably of about 100 to 1250 SUS (20.6 to 269.9 centistokes) at 37.8° C are useful. Examples of relatively common oils of this type are dimethylsilicone polymer, phenylmethylsilicone polymer, chlorophenylmethylsilicone polymer, etc. Methods of preparing such compounds are taught in numerous patents, e.g. U.S. Pat. Nos. 2,410,346 and 2,456,496 and in the literature, such as "Chemistry of Silicones" by Rochow, pages 16 et seq.

Fluorinated polysiloxane falling substantially within the lubricating oil viscosity range can be employed in accordance with the present invention. In general, fluorinated polysiloxanes have the same unit structure as nonfluorinated polysiloxanes previously defined, however, R and R′ differ slightly. R is a hydrogen or an aliphatic hydrocarbon radical having from one to about 3 carbon atoms, R′ is methyl, ethyl, vinyl, phenyl, or $CH_2CH_2R$ in which R represents a perfluoro radical having 1 to about 10 carbon atoms, at least half of the R′ groups being —$CH_2CH_2R$, and *n* is an integer having a value of from 1 to 150 and preferably about 40 to about 150. An example of an fluorinated polysiloxane is trifluoropropyl-methyl-dimethyl polysiloxane which is described in U.S. Pat. No. 3,814,689. Other suitable polysiloxanes embraced by the above general polysiloxane formula and their method of preparation are disclosed in U.S. Pat. No. 2,961,425. For purposes of this invention, the polysiloxanes advantageously have a molecular weight and value of *n* such as to give a viscosity of about 15 to about 100 centistokes, preferably about 65 to about 95 centistokes at 100° F.

Another component suitable as a base oil having a lubricating viscosity is a polyol aliphatic ester having the general formula:

$$R(CH_2O-\overset{\overset{\displaystyle O}{|}}{C}-R')_n$$

wherein R is a substituted alkane containing from one to about 3 carbon atoms, and preferably containing one carbon atom, R′ is an alkyl group having from about 3 to about 12 carbon atoms, preferably about 5 to about 10 carbon atoms, most advantageously 9 carbon atoms, and *n* is an integer having a value of 3 to 4, but most preferably *n* is 4. A preparation of polyol aliphatic esters is disclosed in *Synthetic Lubricants* by Gunderson and Hart, Rheinholt Publishing Corp., 1962, p. 388.

The properties of representative base oils useful in the present invention are compiled in Table 1.

Table 1:

| Properties | Base Oil Properties: Hydrocarbon Mineral Oils Derived from Petroleum | | | Synthetic Hydrocarbon Oils | | Polysiloxanes | | Polyol Aliphatic Ester |
|---|---|---|---|---|---|---|---|---|
| | 500 Texas Oil | 150 MC Bright Stock | Hydrofinished Heavy Neutral Oil | 4 cs Oil | 6 cs Oil | Nonflourinated | Fluorinated | |
| SP. GR. 15.6/15.6° C | 0.918 | 0.898 | 0.883 | 0.8161 | 0.8247 | 1.07 | 1.25 | 0.994 |
| Viscosity, SUS | | | | | | | | |
| 37.8° C (100° F.) | 509 | 2622 | 600 | 86.1 | 155.1 | 394 | | 5.1 |
| 98.9° C (210° F.) | 54.7 | 156.0 | 68.7 | 38.7 | 45.6 | 98.5 | 141.5 | 25 |
| Viscosity, centistokes (cs) | | | | | | | | |
| 37.8° C (100° F.) | 109.8 | 566 | 129.5 | 1718 | 33.12 | 85 | | — |
| 98.9° C (210° F.) | 8.66 | 33.0 | 12.59 | 3.77 | 5.91 | 20 | 30.0 | — |
| Viscosity Index | 30 | 96 | 96 | 120 | 136 | 270 | 220 | 138 |
| Aniline Point, ASTM D-611 | | | | | | | | |
| ° C | 81.1 | 124 | 117.5 | 125.6 | 127.2 | NA* | NA* | NA* |
| ° F | 178 | 255 | 243.5 | 258 | 261 | — | — | — |

*NA = not applicable

Aryl diurea

The grease composition of this invention is thickened to a grease consistency with a specially-defined aryl diurea. The amount of such aryl diurea is a minor portion of the grease composition but should be sufficient to thicken the base oil to a grease consistency. The amount of aryl diruea which can be used may vary depending upon the particular base oil employed and upon the characteristics desired in the ultimate grease composition. The amounts and the preferred ranges of the thickener are given in Table 2. The specially-defined aryl diurea employed in the grease composition of the present invention is the reaction product obtained by reaction of critical molar ratios of a mixture of two specific monoamines, namely p-toluidine and p-chloroaniline, with a toluene diisocyanate.

Toluene diisocyanate is selected from at least one of the group consisting of 2,4-toluene diisocyanate, 2,5-toluene diisocyanate, and 2,6-toluene diisocyanate. 2,4-toluene diisocyanate containing a minor amount of 2,6-toluene diisocyanate is commercially available. 2,5-toluene diisocyanate is not presently commercially available, but its preparation is taught, for example, in the following publications: U.S. Pat. No. 2,264,449 to Morningstar, et al.; German Pat. Nos. 848,810 to Modersoln, et al and 1,118,194 to Morningstar, et al.

A mixture of specific monoamines consisting essentially of p-toluidine and p-chloroaniline, in which the molar ratio of p-toluidine to p-chloroaniline is critical, is reacted with a toluene diisocyanate. Both p-toluidine and p-chloroaniline are commercially available. A combined total of two moles of the amines is reacted with one mole of a toluene diisocyanate. As noted, the molar ratio of p-toluidine to p-chloroaniline in the amine mixture is critical and must be about 3:1 to about 17:1, preferably about 3:1 to about 12:1, and most preferably about 5:1 to about 10:1. An especially preferred ratio is about 7:1. It follows from the stoichimetry of the chemical equation, therefore, that the molar ratio of p-toluidine to p-chloroaniline to toluene diisocyanate is about 3:1:2 to about 17:1:9, preferably about 3:1:2 to about 12:1:6.5, and most preferably about 5:1:3 to about 10:1:5.5, respectively. The preferred ratio is about 7:1:4.

The aryl diurea thickeners of the present invention can be prepared separately and added to the base oil, or, as is often done in the art, prepared in situ with the base oil in accordance with the following reaction equation:

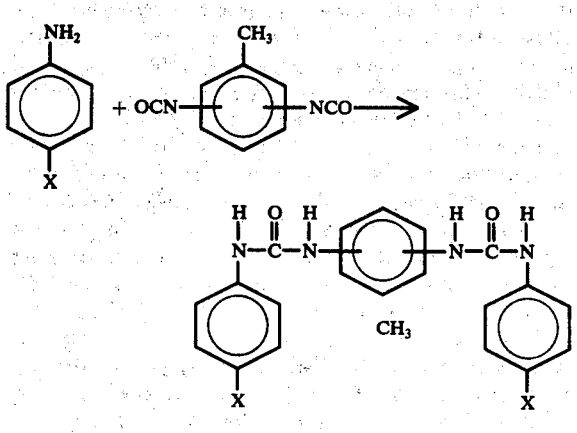

In the first component of the equation, when X is a chloro group (Cl), it defines the p-chloroaniline component of the amine mixture and when X is a methyl group ($CH_3$), it defines the p-toluidine component of the mixture. In the product, therefore, it is apparent that the substituent X can be the same or different.

Typical reaction products include, therefore, but are not limited to, the following compounds:

2,4-[di (3-p-chlorophenylureido)] toluene;
2,5-[di (3-p-chlorophenylureido)] toluene;
2,6-[di (3-p-chlorophenylureido)] toluene;
2,4-[di (3-p-tolylureido)] toluene;
2,5-[di (3-p-tolylureido)] toluene;
2,6-[di (3-p-tolylureido)] toluene;
2,4-[(3-p-chlorophenylureido) (3-p'-p-tolylureido toluene];
2,5-[(3-p-chlorophenylureido) (3-p'-p-tolylureido toluene];
2,6-[(3-p-chlorophenylureido) (3-p'-p-tolylureido toluene].

Precipitated Calcium Carbonate

The precipitated calcium carbonate which is employed in the grease composition of the invention is available commercially so that neither precipitated calcium carbonate per se nor the process by which it is obtained constitutes any portion of the invention. The term "precipitated calcium carbonate" applies to the commercial types of the compound produced by chemical means. It serves to distinguish the commercial types from materials produced by mechanical treatment applied to natural varieties of calcium carbonate such as limestone and chalk. Precipitated calcium carbonate is commonly prepared by three known processes, i.e., the by-product process, the carbonation process, and the calcium chloride process. The process is not important with respect to the precipitated calcium carbonate employed in the grease composition of the present invention. The precipitated calcium carbonate is employed in an amount sufficient to improve the extreme pressure and functional life properties of the grease. The amount of precipitated calcium carbonate which is employed in the grease composition of the present invention may vary depending upon the particular base oil employed and upon the characteristics desired in the ultimate composition. The amounts of precipitated calcium and the preferred ranges are given in Table 2.

Strontium and barium carbonates can not be substituted for precipitated calcium carbonate for the purpose of the present invention, since these compounds do not give the desired results.

Other Additives

The lubricating grease composition of the present invention can contain other lubricant additives, if desired, to improve other specific properties thereof. Thus, the grease composition can contain one or more of the following: an antioxidant, a dispersant an anticorrosion agent, a rust inhibitor, a metal deactivator, other extreme pressure agents, an antiwear agent, a tackiness agent, a dye and the like. Whether or not such additives are employed and the amounts thereof depend to a large extent upon the severity of the conditions to which the composition is subjected. The amounts and preferred ranges of these additives are given in Table 2. They may be added prior to, during, or after the heating steps depending upon the thermal stability of the particular additive employed as will be apparent to those skilled in the art.

Typically the novel grease herein can be prepared by charging to a grease kettle a portion usually from about 30 to about 48 weight percent, and preferable about 36 to about 39 weight percent of a base oil; about 8.06 to about 10.37 weight percent, preferably about 9.0 to about 10.0 weight percent, of p-toluidine; and about 0.72 to about 3.20 weight percent, preferably about 0.75 to 2.5 weight percent, of p-chloroaniline which is stirred and heated to about 80°to 85° C, preferably about 83° C, to dissolve the amines in the base oil. In a separate vessel, about 8.7 to about 9.0 weight percent, preferably about 8.74 to about 8.91 weight percent, of a toluene diisocyanate is mixed with a remaining portion, generally about 30 to about 48 weight percent, preferably about 36 to about 39 weight percent, of the base oil which is then added by a controlled flow rate to the amine solution in the grease kettle. A controlled flow rate is maintained by adding the toluene diisocyanate solution to the amine solution in the grease kettle at a rate so as not to allow the bulk temperature to exceed about 115° to about 127 ° C, preferably about 120° to about 125° C. After the toluene diisocyanate solution is added, the grease composition is stirred and heated to a temperature of about 190° to about 210° C, preferably about 193° to about 199° C for about 15 to about 60 minutes, preferably about 30 minutes. The heating is discontinued and the grease composition is cooled to a suitable temperature for the addition of other additives, approximately 66° to about 93° C. The grease is cooled to about 71 to about 77° C and milled through a colloid mill at a clearance of 0.002 inches. Any suitable pressure can be utilized; atmospheric pressure is therefore preferred.

If the precipitated calcium carbonate is added to the grease, it is added after the grease has been cooled to about 66° to about 93° C, preferably about 75° to about 85° C.

The amounts of the components are summarized in Table 2.

Table 2:

Amounts in Weight Percent of Grease Components

| | Broad Range | Preferred Range | Most Preferred Range |
|---|---|---|---|
| Base Oil | 60 to 88 | 70 to 80 | 70 to 75 |
| Aryl Diurea | 10 to 35 | 15 to 30 | 18 to 25 |

Table 2:-continued

| Amounts in Weight Percent of Grease Components | | | |
|---|---|---|---|
| | Broad Range | Preferred Range | Most Preferred Range |
| Precipitated $CaCO_3$ | 1 to 10 | 2 to 6 | 4 to 5 |
| Other Additives | 0.01 to 10 | 0.2 to 5.0 | 0.3 to 3.0 |

The invention will be further described with reference to the following experimental work.

DESCRIPTION OF PREFERRED EMBODIMENTS

The base oil used in the experiments which follow consisted of varying amounts of (1) a hydrofinished heavy neutral oil, (2) a snythetic hydrocarbon oil (3) a silicone polymer oil, (4) a fluorinated polysiloxane, or (4) a polyol aliphatic ester. The general properties of these base oils are given in Table 1.

The synthetic hydrocarbon oil used in the experiments was obtained from the Gulf Oil Corporation and is named Synfluid, 6 cs.

The nonfluorinated polysiloxane used in the experiments was purchased from Dow Corning Corporation and is named DC 550 Fluid.

The fluorinated polysiloxane used herein was also purchased from Dow Corning Corporation and is known as FS-1265 Fluid.

The polyol aliphatic ester used in the experiments was obtained from Hercules Incorporated under the tradename Herculube J.

The aryl diurea used in the experiments to thicken the lubricating fluid in situ is the reaction product of a toluene diisocyanate with a mixture of p-toluidine and p-chloroaniline. A 2,4-toluene diisocyanate with minor amounts of 2,6-toluene diisocyanate used in the experiments herein is commercially available as DuPont Hylene TM. A 2,5-toluene diisocyanate can be prepared according to the teachings in U.S. Pat. No. 2,642,449 issued to Moringstar et al. in 1953.

P-toluidine and p-chloroaniline used in the experiments were obtained from DuPont.

Precipitated calcium carbonate used in the experiments is available from the Diamond Shamrock Corporation as Multiflex MM.

The oxidation inhibitor used in the experiment was the condensation product of formaldehyde and N,N-dimethylaniline and is available from DuPont under the tradename Ortholeum 304.

The rust inhibitor used in the experiments was an alkenyl succinic acid, where the alkenyl group contains 12 carbon atoms and is available from The Lubrizol Corporation under the tradename Lubrizol 850.

After the greases were prepared, they were subjected to various tests to determine yield, dropping points, and functional life properties. These tests and their significance are described in the following paragraphs.

1. Yield

By yield of a grease is meant the amount of thickener required for a given consistency. For example, a good yield is obtained by using the smallest amount of thickener possible to obtain a grease of a given consistency. The yield is measured by plotting the penetration as determined by ASTM D-1403 against the weight percent thickener. In the present invention it has been found that, while keeping the total amount of thickener constant and varying the molar ratio of p-toluidine to p-chloroaniline, the yield is improved.

2. Dropping Point

It is often desirable to know the temperature at which a particular lubricating grease becomes so hot as to lose its plastic consistency, softening enough to flow. Being a mixture of base oil and thickener, grease has no distinct melting point in the way that homogeneous crystalline substances do. At some elevated temperature, however, the ordinary grease becomes sufficiently fluid to drip. This temperature is known as the dropping point and can be determined by ASTM D-2265.

In the present invention it has been found that, while keeping the total amount of thickener constant, for example at 20 percent, and varying the molar ratio of p-toluidine to p-chloroaniline, the dropping point is improved. A satisfactory lubricant for use in the present invention should have a dropping point above 265° C.

3. Penetration (Consistency)

The penetration or consistency of a lubricating grease used in determining yield and dropping point is defined as its resistance to deformation under an applied force, in other words, its relative stiffness or hardness. The penetration of a grease is often important in determining its suitability for a given application. Grease penetration is given a quantitative basis in ASTM D-217. A desirable penetration value for purposes of this invention is a value from about 260 to about 320.

4. Rust Prevention

The rust preventive properties of greases are measured by ASTM D-1743. A desirable value for the purposes of this invention is No. 1 or 1-1. In addition to the other desirable grease properties, the greases of the present invention pass the ASTM D-1743 without the addition of sodium nitrite, a known contributor to bearing noise.

5. Dynamic Oxidation

An important consideration in a grease composition is its shear stability when subjected to high pressure in a roller bearing under oxidizing conditions. Such a test is referred to as the Dynamic Oxidation Stability Test. In conducting the Dynamic Oxidations Stability Test a 20-gram sample of the grease composition to be evaluated is placed in a bomb as described in ASTM D-942. A metal roller 3.42 × 1⅛in. diameter is placed in the bomb so that the roller will turn in a rolling manner as the bomb is rotated. The roller can be made from stainless steel or brass. The bomb containing the grease and roller is charged with oxygen at a pressure of 758.4 kPa (110 psi). The oxygen-charged bomb containing the grease and metal roller is then placed in an oven maintained at 243° F. (117° C). The bomb temperature is 210° F. (98.9° C). The bomb is rotated to 50 rpm. The pressure drop within the bomb is recorded periodically (24, 48, 72 and 96 hours). At the end of the test period, the penetration value of the grease is measured and compared with the penetration at the start of the test. The least amount of change in penetration value is desirable. A desirable result for purposes of this invention would be about 90 or less. A "+" penetration change means the grease composition being measured grew softer in consistency; a "−" penetration change value means the grease composition being measured grew harder in consistency under the conditions imposed by the Dynamic Oxidation Stability Test.

6. Functional Life a. Modified Pope Spindle Test

A modified Pope Spindle test is used to illustrate the functional life properties of grease compositions which are prepacked and then stored in bearings for long periods before use.

According to current production techniques, many bearings are prepacked with lubricating compositions and then stored for long periods before they are used. Thus an effective lubricant for prepacked bearings must have a consistency to assure adequate retention in the bearings during storage. However, the lubricant must not be too hard to give adequate lubrication on subsequent use. A soft grease tends to flow at normal atmospheric temperature and consequently such a grease may drain from the bearing prior to being placed in service, thus giving rise to inadequate lubrication when the bearing is used. A hard grease does not flow from the bearing during storage, but a hard grease does not have adequate flow properties to supply necessary lubrication during use of the bearing. A satisfactory lubricating grease composition for use at 177° C. must, therefore, have a consistency which will give adequate lubrication at temperatures of 177° C. without flowing from the bearing during storage at normal atmospheric temperture.

A satisfactory lubricant for use in bearings operating at speeds up to 10,000 revolutions per minute and at temperatures up to about 177° C should have a Pope Spindle functional life of at least 775 or higher hours, preferably 775 to 2000+ hours, when determined by a procedure outlined by the Coordinating Research Council, "Research Technique for the Determination of Performance Characteristics of Lubricating Grease Antifriction Bearings at Elevated Temperatures," CRC Designation L-35.

In order to illustrate the lubricating characteristics of grease compositions of the invention when used to lubricate bearings operating at 177° C. and at rotational speeds of 10,000 revolutions per minute, Pope Spindles were used in a test procedure similar to that outlined by the Coordinating Research Council Tentative Draft (July,1954), "Research Technique for the Determination of Performance Characteristics of Lubricating Grease in Antifriction Bearings at Elevated Temperatures," CRC Designation L-35 and *Federal Test Method Standard No.* 791*a*, Method No. 333. According to the CRC L-35 test method, the test bearings are packed with 3.5 cc (or equivalent weight) of grease. Because of the extremely short life of bearings packed with 3.5 cc of grease, the present evaluations were made by packing the bearings completely full with about 6 to 8 grams of grease and using a standard end cap with no additional grease, a modification of the literature test procedure. The bearing assembly containing an eightball Fafnir 204K ball bearing is mounted on a horizontal spindle and is subjected to a radial load of 5 pounds. The portion of the spindle upon which the test bearing assembly is located is encased in a thermostatically controlled oven. By this means the temperature of the bearing can be maintained at a desired elevated temperature which in the tests reported hereinafter was 177° C. The spindle is driven by a constant belt-tension motor drive assembly, capable of giving spindle speeds of 10,000 revolutions per minute. The spindle is operated on a cycling schedule consisting of a series of 24-hour periods, each period consisting of 20 hours running time and 4 hours shut-down time. The test continues until the lubricant fails. The lubricant is considered to have failed when any one of the following conditions occurs: (1) spindle input power increases to a value approximately 300 percent above the steadystate condition at the test temperature; (2) an increase in temperature at the test bearing of 10° C. over the test temperature during any portion of a cycle; or (3) the test bearing locks or the drive belt slips at the start or during the test cycle.

b. Modified ASTM D-1741

The functional life of the grease was also determined by ASTM D-1741, procedure B, except the test was modified by increasing the temperture to 300° F. (149° C ); otherwise the procedure was unchanged. ASTM D-1741 is a more severe test than the Pope Spindle. One factor of the increased severity is due to the use of larger bearings. Also, the temperature was increased from 125° C. to 149° C. to make the test more severe. An acceptable value for a modified ASTM D-1741 is a value of 550 hours or above.

7. Measurement of Extreme Pressure Properties

The Four-Ball E.P. Test ASTM D-2569 is a standard test in the industry. An acceptable weld point for the four ball E.P. Test, ASTM D-2566 is 250 kg. or above for the greases disclosed herein.

8. Measurement of Wear Preventive Properties

The four ball wear test, ASTM D-2266, modified to 130° F. (54.5° C) at 1800 rpm at 20 and 40 kg loads, is also a standard test in the industry. An acceptable value for this test is 0.6 mm or lower at 20 kg. and 1.0 mm or lower at 40 kg. for the greases disclosed herein.

EXAMPLE 1

Grease Composition Containing P-toluidine, P-chloroaniline, and Toluene Diisocyanate in a Molar Ratio of 7:1:4

The lubricating grease composition of the present invention was prepared by charging to a grease kettle 1580 grams of hydrofinished heavy neutral base oil, 382.4 grams of p-toluidine, and 62.4 grams of p-chloroaniline. The contents were stirred and heated to 83° C. In a separate container, 355.2 grams of 2,4 -toluene diisocyanate were mixed with 1580 grams of a hydrofinished heavy neutral base oil and then added to the contents of the grease kettle by a controlled flow rate, i.e., at a rate so that the bulk temperature did not exceed 121° C. After the addition, the contents of the grease kettle were stirred and heated to 193° to 199° C. for a half hour. The heating was then discontinued and the grease composition was cooled to 116° C. 20 grams of the condensation product of formaldehyde and N,N-dimethylaniline, an oxidation inhibitor, was blended into the grease composition. The grease composition was further cooled to below 93° C., and 20 grams of an alkenyl succinic acid, a rust inhibitor, was added. The grease was cooled to 71° to 77° C. and milled through a colloid mill at a clearance of 0.002 inches.

A first series of lubricating grease compositions following the procedure in Example 1 was prepared using identical materials except that the molar ratio of p-toluidine to p-chloroaniline was varied. The results of this series are reported in Table 3.

Table 3:

| Effect of Molar Ratio on Grease Properties | | | | | |
|---|---|---|---|---|---|
| Example Number | 1 | 2 | 3 | 4 | 5 |
| Grease Makeup, wt.% | | | | | |
| hydrofinished heavy neutral | 79.00 | 79.00 | 79.00 | 79.00 | 79.00 |
| p-chloroaniline | 9.56 | 8.06 | 5.24 | 2.56 | 10.37 |
| 2,4 1.56 | 3.20 | 6.24 | 9.13 | 0.72 | |
| 2,4 toluene diisocyanate | 8.88 | 8.74 | 8.52 | 8.31 | 8.91 |
| oxidation inhibitor | 0.50 | 0.50 | 0.50 | 0.50 | 0.50 |
| rust inhibitor 0.50 | 0.50 | 0.50 | 0.50 | 0.50 | |
| molar ratio (p-toluidine to p-chloroaniline to toluene diisocyanate) | 7:1:4 | 3:1:2 | 1:1:1 | 0.33:1:6 | 17.2:1:9 |
| Inspections | | | | | |
| Dropping Point, modified ASTM D-2265, ° C (° F) | 322 | 318 | 309 | 304 | 318 |
| Penetration, ASTM D-1403, ¼scale | | | | | |
| unworked | 275 | 257 | 332 | 339 | 290 |
| worked, 60 strokes | 287 | 298 | 339 | 355 | 298 |
| Penetration, ASTM D-217 | | | | | |
| unworked | 260 | 240 | 324 | 333 | 288 |
| worked, 60 strokes | 278 | 292 | 332 | 362 | 289 |
| worked, 10,000 strokes | 300 | 323 | 354 | 400 | 303 |
| Rust Prevention, ASTM D-1743 | No. 1 | No. 1 | No. 1 | No. 1 | No. 1 |
| Dynamic Oxidation, pressure drop: kPa (psi) | | | | | |
| 24 hours | 0(0) | 0(0) | 0(0) | 0(0) | 0(0) |
| 48 hours | 0(0) | 0(0) | 0(0) | 0(0) | 0(0) |
| 72 hours | 0(0) | 0(0) | 0(0) | 0(0) | 0(0) |
| 96 hours | 13.8(2) | 20.7(3) | 34.5(5) | 20.7(3) | 0(0) |
| penetration change | +6 | °12 | −37 | −34 | +7 |
| Functional Life | | | | | |
| Pope Spindle, hours | 784 | 784 | 614 | 762 | 773 |
| Modified ASTM D-1741, hours | 629 | 642 | 575 | 569 | 650 |

Referring to Table 3, it can be seen that the excellent lubricating grease compositions are Examples 1, 2 and 5 where the molar ratio varied from 3:1:2 to 17.2:1:9. Example 1 is an especially preferred lubricating grease composition for the purposes of the present invention. In Examples 1, 2 and 5, acceptable values were obtained for dropping point and functional life as shown in Table 3, as well as excellent yields. Examples 3 and 4 have both poor yields and low functional life values.

A second series of lubricating grease compositions was prepared identical to Example 1 of the first series of compositions except that various amine compounds known in the art were substituted for p-toluidine and p-chloroaniline in the 7:1 molar ratio. Results of this series are reported in Table 4.

Table 4:

| Criticality of p-Toluidine and p-Chloroaniline on Grease Properties | | | | | |
|---|---|---|---|---|---|
| Example Number | 6 | 7 | 8 | 9 | 10 |
| Grease Makeup, wt.% | | | | | |
| hydrofinished heavy neutral | 79.00 | 79.00 | 79.00 | 79.00 | 79.00 |
| p-toluidine | 9.56 | 9.47 | 9.47 | 9.56 | — |
| p-chloroaniline | — | — | — | — | 1.43 |
| m-chloroaniline | — | — | — | 1.56 | — |
| o-chloroaniline | 1.56 | — | — | — | — |
| p-aminobenzoic acid | — | 1.73 | — | — | 10.76 |
| p-nitroaniline | — | — | 1.74 | — | — |
| 2,4 toluene diisocyanate | 8.88 | 8.80 | 8.79 | 8.88 | 7.81 |
| oxidation inhibitor | 0.50 | 0.50 | 0.50 | 0.50 | 0.50 |
| rust inhibitor | 0.50 | 0.50 | 0.50 | 0.50 | 0.50 |
| Inspections | | | | | |
| Dropping Point, modified ASTM D-2265, ° C | 301 | 295 | too thin | 303 | too thin |
| Penetration, ASTM D-1403, ¼ scale | | | | | |
| unworked | 332 | 343 | 437 | 302 | 450+ } Very thin |
| worked, 60 strokes | 347 | 373 | 444 | 306 | 450+ } Very thin |
| Penetration, ASTM D-217 | | | | | |
| unworked | Soft | Soft | Very soft | Soft | Very Soft |
| worked, 60 strokes | | | | | |
| worked, 10,000 strokes | | | | | |

From Table 4 it can be concluded that when amines other than p-toluidine and p-chloroaniline are used in the desirable molar ratios extremely poor results are obtained. The compositions in Examples 6 through 10 were too soft and thin to give a useful grease consistency for further evaluations in tests used to characterize the greases of the present invention.

A third series of lubricating grease compositions was prepared identical to Example 1 of the first series to study the effect of varying the amounts of precipitatd calcium carbonate on the properties of the grease composition of the present invention. The results of the series are reported in Table 5.

Table 5:

| Effect of Precipitated Calcium Carbonate on Grease Properties | | | | |
|---|---|---|---|---|
| Example Number | 1 | 11 | 12 | 13 |
| Grease Makeup, wt.% | | | | |
| hydrofinished heavy neutral | 79.00 | 77.00 | 75.00 | 73.00 |
| p-toluidine | 9.56 | 9.56 | 9.56 | 9.56 |
| p-chloroaniline | 1.56 | 1.56 | 1.56 | 1.56 |

Table 5:-continued

| Effect of Precipitated Calcium Carbonate on Grease Properties | | | | |
|---|---|---|---|---|
| Example Number | 1 | 11 | 12 | 13 |
| 2,4 toluene diisocyanate | 8.88 | 8.88 | 8.88 | 8.88 |
| oxidation inhibitor | 0.50 | 0.50 | 0.50 | 0.50 |
| rust inhibitor | 0.50 | 0.50 | 0.50 | 0.50 |
| precipitated calcium carbonate | 0 | 2 | 4 | 6 |
| Inspections | | | | |
| Dropping point, modified ASTM D-2265, °C (°F) | 322(661) | 317(602) | 321(609) | 321(610 |
| Penetration, ASTM D-1403, ¼ scale | | | | |
| unworked | 275 | 284 | 282 | 286 |
| worked, 60 strokes | 287 | 289 | 287 | 290 |
| Penetration, ASTM D-217 | | | | |
| unworked | 260 | 274 | 270 | 275 |
| worked, 60 strokes | 278 | 283 | 285 | 281 |
| worked, 10,000 strokes | 300 | 304 | 308 | 305 |
| Rust Prevention, ASTM D-1743 | No. 1 | No. 1 | No. 1 | No. 1 |
| Dynamic Oxidation, pressure drop: kPa(psi) | | | | |
| 24 hours | 0(0) | 0(0) | 0(0) | 0(0) |
| 48 hours | 0(0) | 0(0) | 0(0) | 0(0) |
| 72 hours | 0(0) | 0(0) | 0(0) | 0(0) |
| 96 hours | 13.8(2) | 20.7(3) | 20.7(3) | 13.8(2) |
| penetration change | +6 | +22 | +3 | +8 |
| Functional Life | | | | |
| Pope Spindle, hours | 784 | 1107 | 1321 | 1211 |
| Modified ASTM D-1741, hours | 620 | 729 | 947 | 806 |
| Four Ball E.P., ASTM D-2596 | | | | |
| Load Wear Index | 17.6 | 45.1 | 49.6 | 62.3 |
| Weld Point, kg | 126 | 250 | 400 | 500 |

The results recorded in Table 5 demonstrate that the addition of precipitated calcium carbonate in any amount improves the e.p. properties and functional life of the grease compositions of the invention. Especially preferred grease compositions using precipitated calcium carbonate are defined by Examples 11, 12 and 13 in which the amount of precipitated calcium carbonate was 2, 4 and 6 weight percent, respectively, of the total grease composition.

A fourth series of lubricating grease compositions was prepared identical to Example 1 of the first series of compositions except that various base oils were substituted for the hydrofinished heavy neutral oil, a natural hydrocarbon mineral oil; and Examples 15, 16 and 17 contained 4 weight percent precipitated calcium carbonate. The 4 weight percent of precipitated calcium carbonate was added in the same step as the rust inhibitor in Example 1, i.e., after the composition was cooled below 93° C. The results of this series are reported in Table 6.

Table 6:

| Greases Containing Various Base Oils | | | | |
|---|---|---|---|---|
| Example Number | 14 | 15 | 16 | 17 |
| Grease Makeup, wt.% | | | | |
| synthetic hydrocarbon oil | 79.00 | — | — | — |
| polysiloxane, non-fluorinated | — | 75.00 | — | — |
| polysiloxane, fluorinated | — | — | 75.00 | — |
| polyolester | — | — | — | 75.00 |
| p-toluidine | 9.56 | 9.56 | 9.56 | 9.56 |
| p-chloroaniline | 1.56 | 1.56 | 1.56 | 1.56 |
| 2,4 toluene diisocyanate | 8.88 | 8.88 | 8.88 | 8.88 |
| precipitated calcium carbonate | — | 4.00 | 4.00 | 4.00 |
| oxidation inhibitor | 0.50 | 0.50 | 0.50 | 0.50 |
| rust inhibitor | 0.50 | 0.50 | 0.50 | 0.50 |
| Inspections | | | | |
| Functional Life | | | | |
| Pope Spindle, hours | 890 | 2000+ | 2000+ | 2000+ |
| Modified ASTM D-1741, hours | 639 | — | — | — |

From the data reported in Table 6, it can be shown that any base oil having a lubricating viscosity, natural or synthetic, is suitable for use in the grease compositions of the present invention. Further, grease compositions using a synthetic hydrocarbon oil (Example 14), a nonfluorinated polysiloxane (Example 15), a fluorinated siloxane (Example 16), and a polyolester (Example 17) result in a still greater increase in the functional life of the grease. A"+" in the functional life data of Table 6 indicates that the test was terminated for expediency at 2000 hours, but that the grease had not failed.

The examples set forth are to illustrate, not to limit, the invention, whereby those skilled in the art may understand more fully the nature in which the present invention can be carried into effect.

What is claimed is:

1. A lubricating grease comprising a base oil of lubricating viscosity thickened to a grease with a mixture of aryl diureas obtained by reacting an aryl amine mixture of p-toluidine and p-chloroaniline with a toluene diisocyanate in the proportion of two moles of said aryl amine mixture per mole of said diisocyanate, the mole ratio of p-toluidine to p-chloroaniline in said aryl amine mixture ranging from about 3:1 to about 17:1.

2. A lubricating grease according to claim 1 wherein said mole ratio of p-toluidine to p-chloroaniline is about 3:1 to about 12:1.

3. A lubricating grease according to claim 1 wherein said mole ratio of p-toluidine to p-chloroaniline is about 5:1 to about 10:1.

4. A lubricating grease according to claim 1 wherein said mole ratio of p-toluidine to p-chloroaniline is about 7:1.

5. A lubricating grease according to claim 1 wherein said base oil is selected from at least one of the group consisting of a hydrocarbon mineral oil derived from petroleum, a synthetic hydrocarbon oil, a polysiloxane and a polyol aliphatic ester.

6. A lubricating grease according to claim 1 wherein said toluene diisocyanate is selected from at least one of the group consisting of 2,4 toluene diisocyanate, 2,5 toluene diisocyanate and 2,6 toluene diisocyanate.

7. A lubricating grease according to claim 1 wherein said aryl diurea is present in an amount from about 10 to about 35 weight percent of the total composition.

8. A lubricating grease according to claim 1 wherein said aryl diurea is present in an amount from about 18 to about 25 weight percent of the total composition.

9. A lubricating grease according to claim 5 wherein said base oil is a hydrocarbon mineral oil derived from petroleum.

10. A lubricating grease according to claim 5 wherein said base oil is a synthetic hydrocarbon oil.

11. A lubricating grease according to claim 5 wherein said base oil is a polysiloxane.

12. A lubricating grease according to claim 5 wherein said base oil is a polyol aliphatic ester.

13. A lubricating grease according to claim 6 wherein said toluene diisocyanate is 2,4 toluene diisocyanate.

14. A lubricating grease according to claim 6 wherein said toluene diisocyanate is 2,6 toluene diisocyanate.

15. A lubricating grease according to claim 6 wherein said toluene diisocyanate is 2,5 toluene diiosocyanate.

16. A lubricating grease according to claim 1 which further includes a precipitated calcium carbonate in an amount ranging from about 1 to about 10 percent by weight of the total composition.

17. A lubricating grease according to claim 1 which further includes a precipitated calcium carbonate in an amount ranging from about 2 to about 6 percent by weight of the total composition.

18. A lubricating grease according to claim 1 wherein said base oil is a synthetic hydrocarbon oil, said toluene diisocyanate is 2,4 toluene diisocyanate and said mole ratio of p-toluidine to p-chloroaniline is about 7:1.

19. A lubricating grease according to claim 1 wherein said base oil is a synthetic hydrocarbon oil, said toluene diisocyanate is 2,4 toluene diisocyanate, said mole ratio of p-toluidine to p-chloroaniline is about 7:1, and said lubricating grease further includes about 4 percent by weight of a precipitated calcium carbonate.

20. A lubricating grease according to claim 1 wherein said base oil is a polysiloxane, said toluene diisocyanate is 2,4 toluene diisocyanate, said mole ratio of p-toluidine to p-chloroaniline is about 7:1, and said lubricating grease further includes about 4 percent by weight of a precipitated calcium carbonate.

* * * * *

UNITED STATES PATENT AND TRADEMARK OFFICE

CERTIFICATE OF CORRECTION

PATENT NO. : 4,065,395

DATED : December 27, 1977

INVENTOR(S) : Wayne W. Bailey

It is certified that error appears in the above-identified patent and that said Letters Patent are hereby corrected as shown below:

COL 1, line 51, "imposed" should be --improved--.

COL 7, line 17, "(4)" should be --(5)--.

COL 8, line 52, "to" should be --at--.

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*

Table 3: Effect of Molar Ratio on Grease Properties

| Example Number | 1 | 2 | 3 | 4 | 5 |
|---|---|---|---|---|---|
| Grease Makeup, wt.% | | | | | |
| hydrofinished heavy neutral | 79.00 | 79.00 | 79.00 | 79.00 | 79.00 |
| p-toluidine | 9.56 | 8.06 | 5.24 | 2.56 | 10.37 |
| p-chloroaniline | 1.56 | 3.20 | 6.24 | 9.13 | 0.72 |
| 2,4 toluene diisocyanate | 8.88 | 8.74 | 8.52 | 8.31 | 8.91 |
| oxidation inhibitor | 0.50 | 0.50 | 0.50 | 0.50 | 0.50 |
| rust inhibitor | 0.50 | 0.50 | 0.50 | 0.50 | 0.50 |
| molar ratio (p-toluidine to p-chloroaniline to toluene diisocyanate) | 7:1:4 | 3:1:2 | 1:1:1 | 0.33:1:6 | 17.2:1:9 |
| Inspections | | | | | |
| Dropping Point, modified ASTM D-2265, °C (°F) | 322 | 318 | 309 | 304 | 318 |
| Penetration, ASTM D-1403, 1/4 scale | | | | | |
| unworked | 275 | 257 | 332 | 339 | 290 |
| worked, 60 strokes | 287 | 298 | 339 | 355 | 298 |
| Penetration, ASTM D-217 | | | | | |
| unworked | 260 | 240 | 324 | 333 | 288 |
| worked, 60 strokes | 278 | 292 | 332 | 362 | 289 |
| worked, 10,000 strokes | 300 | 323 | 354 | 400 | 303 |
| Rust Prevention, ASTM D-1743 | No. 1 | No. 1 | No. 1 | No. 1 | No.1 |
| Dynamic Oxidation, pressure drop: kPa (psi) | | | | | |
| 24 hours | 0(0) | 0(0) | 0(0) | 0(0) | 0(0) |
| 48 hours | 0(0) | 0(0) | 0(0) | 0(0) | 0(0) |
| 72 hours | 0(0) | 0(0) | 0(0) | 0(0) | 0(0) |
| 96 hours | 13.8(2) | 20.7(3) | 34.5(5) | 20.7(3) | 0(0) |
| penetration change | +6 | +12 | -37 | -34 | +7 |
| Functional Life | | | | | |
| Pope Spindle, hours | 784 | 784 | 614 | 762 | 773 |
| Modified ASTM D-1741, hours | 629 | 642 | 575 | 569 | 650 |